US011200871B2

(12) United States Patent
Higgins

(10) Patent No.: US 11,200,871 B2
(45) Date of Patent: Dec. 14, 2021

(54) PICK HOLDER FOR STRINGED MUSICAL INSTRUMENT PICKS

(71) Applicant: Innoversal Products, LLC, Hamburg, NY (US)

(72) Inventor: Nicholas James Higgins, Hamburg, NY (US)

(73) Assignee: Innoversal Products, LLC, Hamburg, NY (US)

( * ) Notice: Subject to any disclaimer, the term of this patent is extended or adjusted under 35 U.S.C. 154(b) by 0 days.

(21) Appl. No.: 17/086,092

(22) Filed: Oct. 30, 2020

(65) Prior Publication Data

US 2021/0134255 A1 May 6, 2021

Related U.S. Application Data

(60) Provisional application No. 62/928,085, filed on Oct. 30, 2019.

(51) Int. Cl.
*G10D 3/173* (2020.01)

(52) U.S. Cl.
CPC ..... *G10D 3/173* (2020.02)

(58) Field of Classification Search
CPC ..... G10D 13/02; G10D 13/16; G10D 13/20; G10D 13/22
See application file for complete search history.

(56) References Cited

U.S. PATENT DOCUMENTS 4,785,708 A * 11/1988 Vaughan ..... G10D 3/173 84/329
5,905,217 A * 5/1999 Byers ..... G10D 3/173 84/322
2006/0096440 A1* 5/2006 Weathersby ..... G10D 3/173 84/322

* cited by examiner

*Primary Examiner* — Kimberly R Lockett
(74) *Attorney, Agent, or Firm* — Jacob D. Merrill, Esq.; Harter Secrest & Emery LLP

(57) ABSTRACT

A string instrument pick holder assembly including a pouch operable to store one or more instrument picks. The pouch having an inner surface configured to contain the one or more picks, and an outer surface located opposite the inner surface. The string instrument pick holder assembly further including a saddle having a first surface and a second surface, wherein the second surface is located opposite the first surface, and a strap coupled with the saddle, wherein the strap is operable connect the saddle with a string instrument. A first portion of a fastener is connected with the outer surface of the pouch, and a second portion of the fastener is coupled with the first surface of the saddle. The second portion of the fastener is operable to detachably connect with the first portion of the fastener.

20 Claims, 15 Drawing Sheets

PICK HOLDER FOR STRINGED MUSICAL INSTRUMENT PICKS

TECHNICAL FIELD

The present disclosure relates generally to a musical instrument accessory, and more specifically to a string instrument accessory for storing picks.

BACKGROUND

Numerous string instruments are played (i.e., operated) by plucking or strumming the strings of the instrument. Many musicians utilize a pick, also referred to as a plectrum, to pluck and/or strum the strings of a string instrument. The present disclosure provides a method and apparatus for storing picks such that they are accessible while utilizing a string instrument.

SUMMARY

The present disclosure provides for a string instrument accessory assembly.

In a first exemplary embodiment, a string instrument pick holder assembly (100) includes a pouch (150) operable to store one or more instrument picks (10). The pouch having an inner surface (157) configured to contain the one or more picks, and an outer surface (155) located opposite the inner surface. A first portion (132) of a fastener (130, 132) is connected with the outer surface of the pouch. The string instrument pick holder assembly further includes a saddle (120, 220) having a first surface (122, 222) and a second surface (124, 224), wherein the second surface is located opposite the first surface. A second portion (130) of the fastener is coupled with the first surface. The second portion of the fastener is operable to detachably connect with the first portion of the fastener. The string instrument pick holder assembly further includes a strap (102, 102A, 102B) coupled with the saddle, wherein the strap is operable to connect the saddle with a string instrument (12).

In a second exemplary embodiment, a string instrument accessory assembly (100) includes a saddle (120, 220) having a first surface (122, 124) and a second surface (124, 224), wherein the second surface is located opposite the first surface. A first portion (130, 230) of a fastener (130, 132; 230, 232) is coupled with the first surface of the saddle. The string instrument pick holder assembly further includes an accessory (150) having a second portion (132, 232) of the fastener operable to detachably connect with the first portion of the fastener. Further, a strap (102, 102A) is coupled with the saddle, wherein the strap is operable to connect the saddle with a string instrument (12).

BRIEF DESCRIPTION OF THE DRAWINGS

The accompanying drawings are incorporated herein as part of the specification. The drawings described herein illustrate embodiments of the presently disclosed subject matter and are illustrative of selected principles and teachings of the present disclosure. However, the drawings do not illustrate all possible implementations of the presently disclosed subject matter and are not intended to limit the scope of the present disclosure in any way.

DETAILED DESCRIPTION

Figure 1:
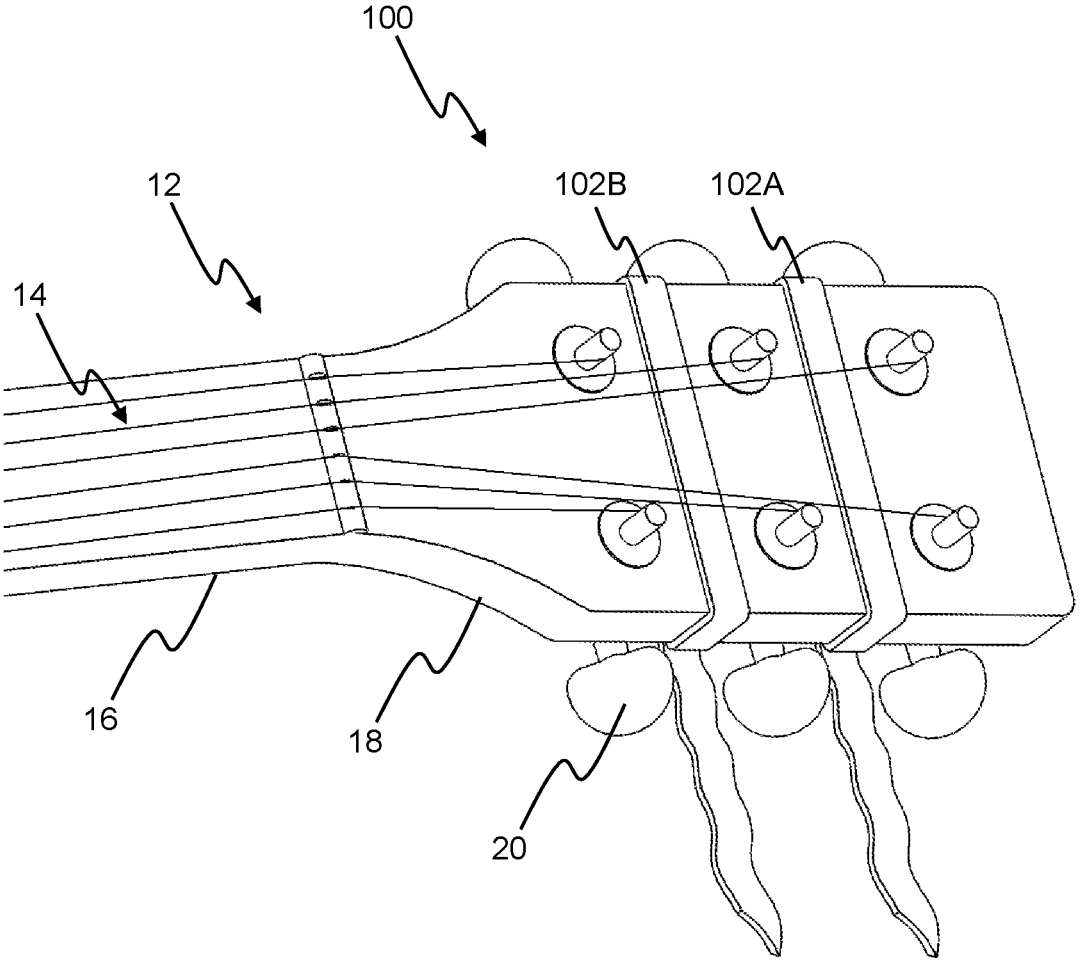
FIG. 1 shows a front perspective view of a portion of a string instrument and pick holder assembly according to an embodiment of the present disclosure.

It is to be understood that the invention may assume various alternative orientations and step sequences, except where expressly specified to the contrary. It is also to be understood that the specific assemblies and systems illustrated in the attached drawings and described in the following specification are simply exemplary embodiments of the inventive concepts defined herein. Hence, specific dimensions, directions, or other physical characteristics relating to the embodiments disclosed are not to be considered as limiting, unless expressly stated otherwise. Also, although they may not be, like elements in various embodiments described herein may be commonly referred to with like reference numerals within this section of the application.

Where they are used herein, the terms "first", "second", and so on, do not necessarily denote any ordinal, sequential, or priority relation, but are simply used to more clearly distinguish one element or set of elements from another, unless specified otherwise.

As illustrated in FIGS. 1-4, in an embodiment, a string instrument pick holder assembly 100 is operable to hold one or more picks 10 (i.e., plectrum) for plucking and/or strumming strings 14 of a string instrument 12. The string instrument pick holder assembly 100 enables the user to connect the string instrument pick holder assembly 100 onto their string instrument 12 for storing multiple picks 10 of varying shapes and sizes.

Figure 2A:
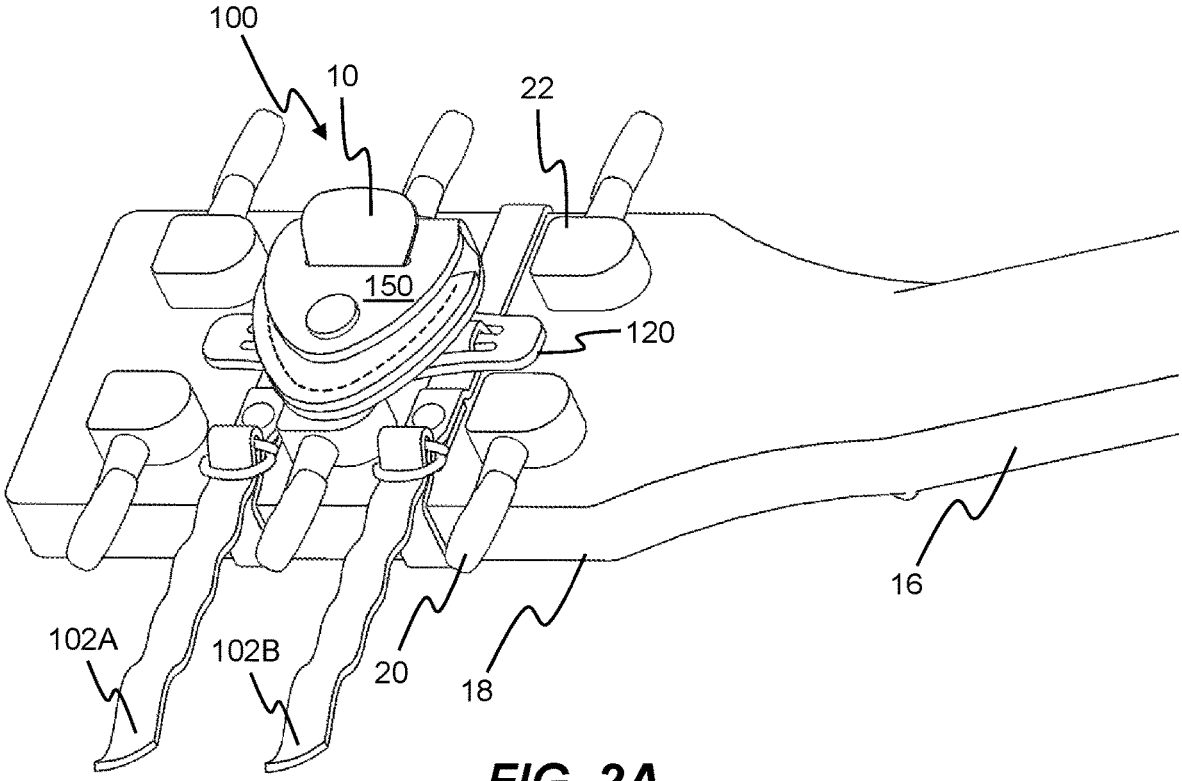
FIG. 2A shows a rear perspective view of a portion of the string instrument and pick holder assembly according to FIG. 1.
Figure 2B:
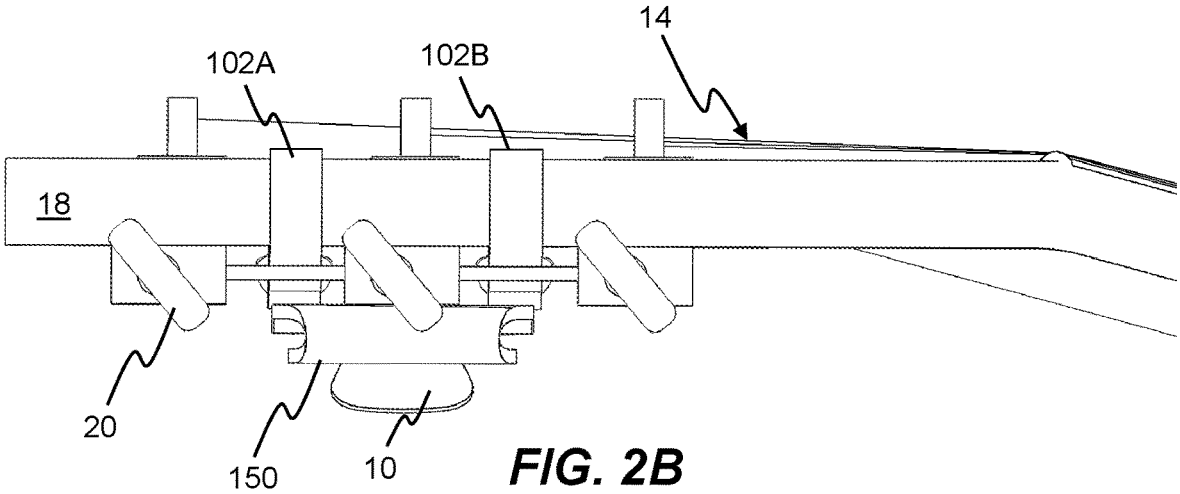
FIG. 2B shows a side view of a portion of the string instrument and pick holder assembly according to FIG. 1.
Figure 3:
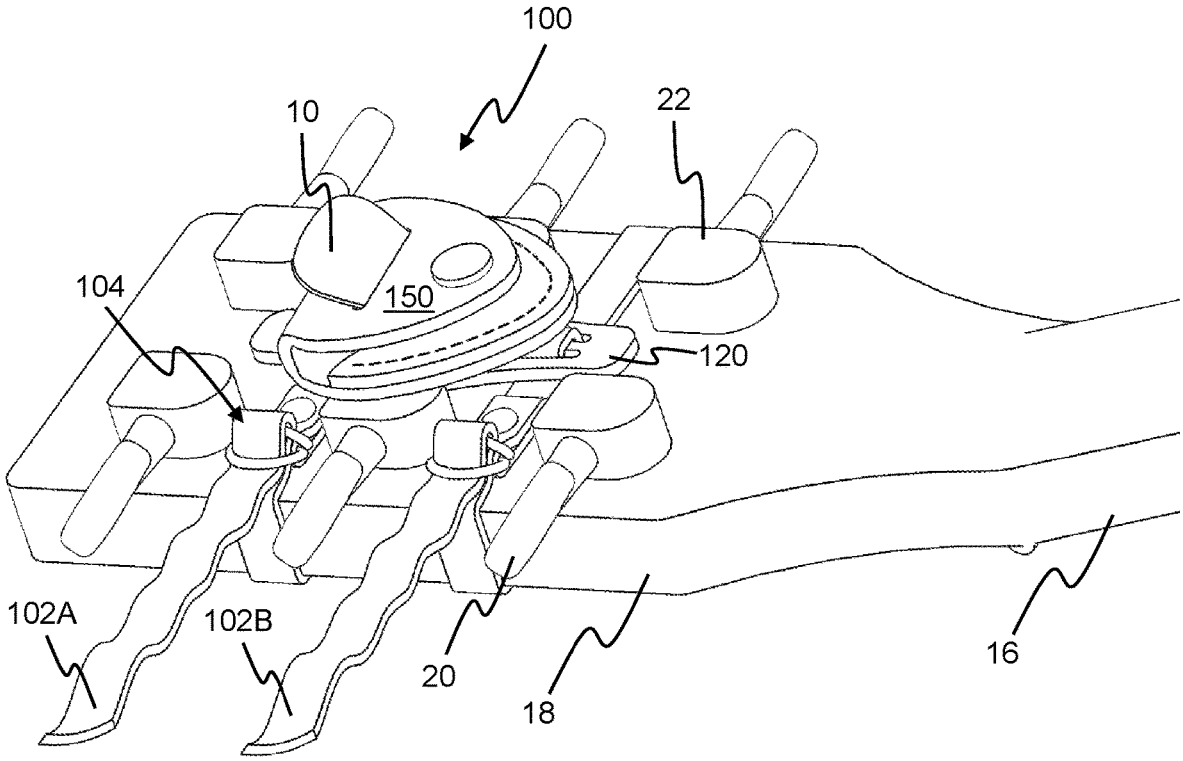
FIG. 3 shows a rear perspective view of a portion of the string instrument and pick holder assembly according to FIG. 1 where the pick holder is rotated.
Figure 4:
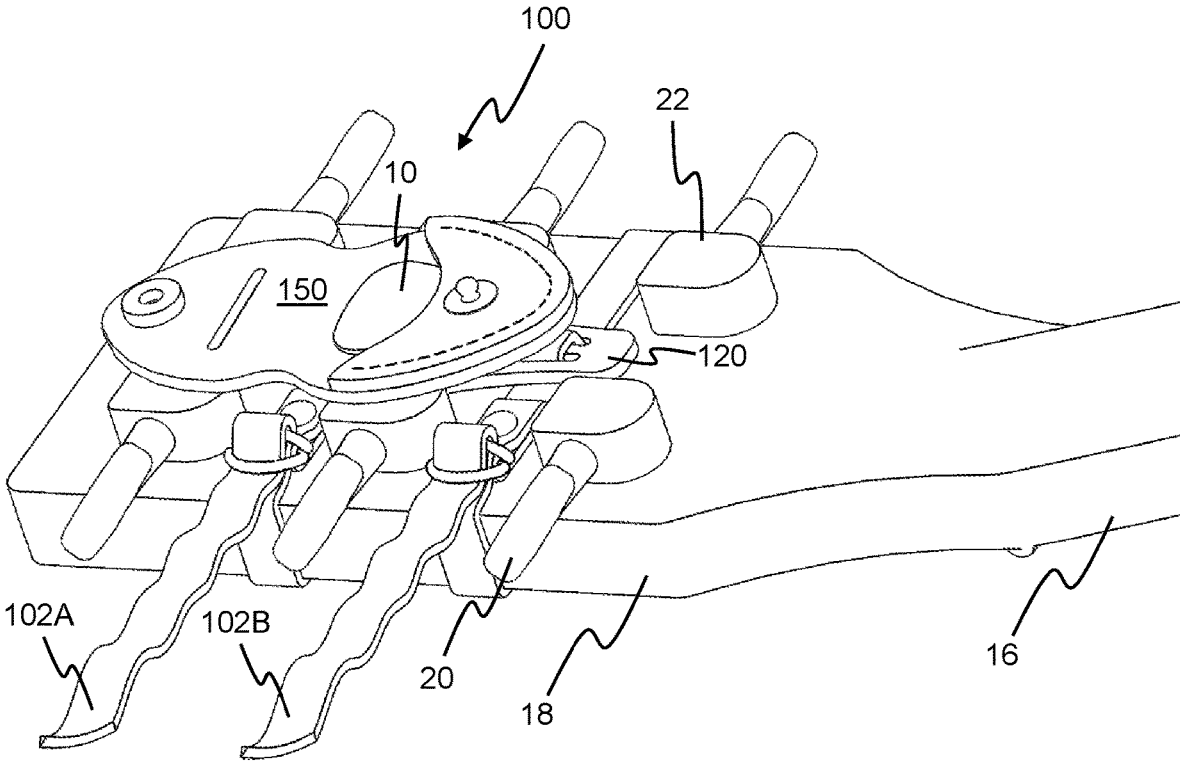
FIG. 4 shows a rear perspective view of a portion of the string instrument and pick holder assembly according to FIG. 1 in an open position.
Figure 5:
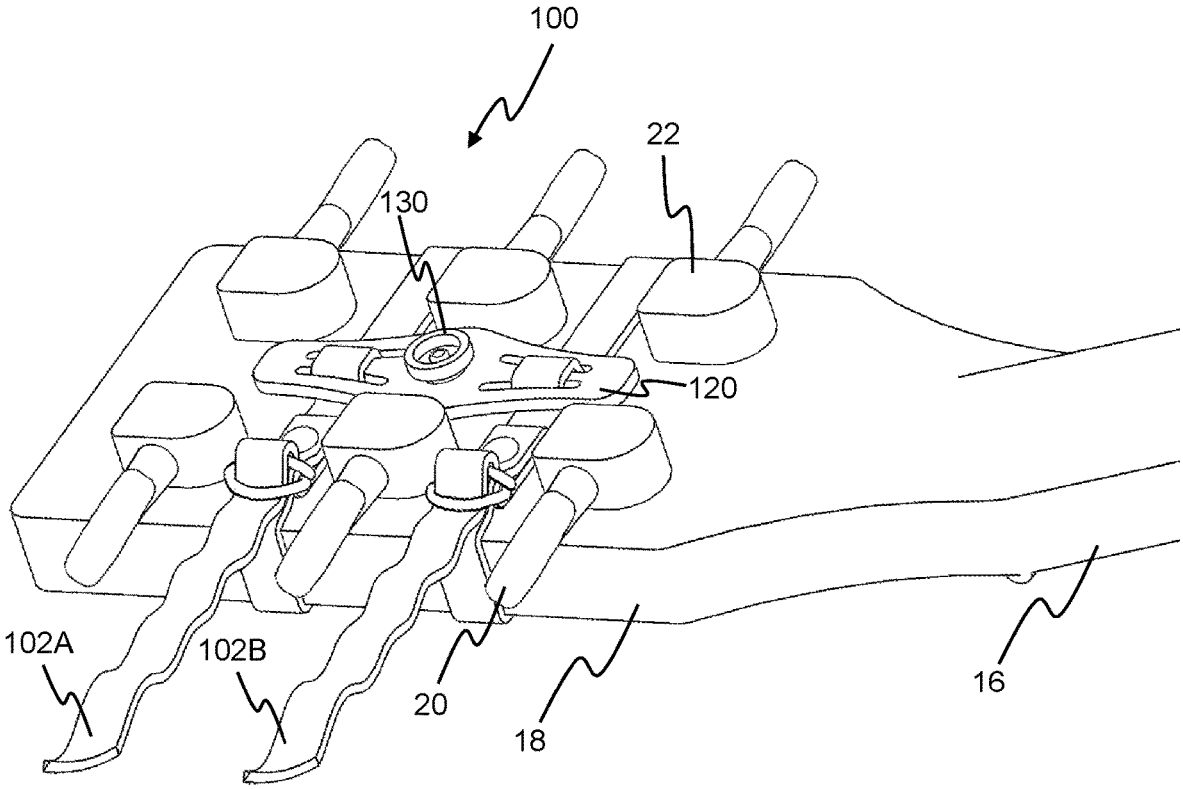
FIG. 5 shows a rear perspective view of a portion of the string instrument and a portion of the pick holder assembly according to FIG. 1.
Figure 6:
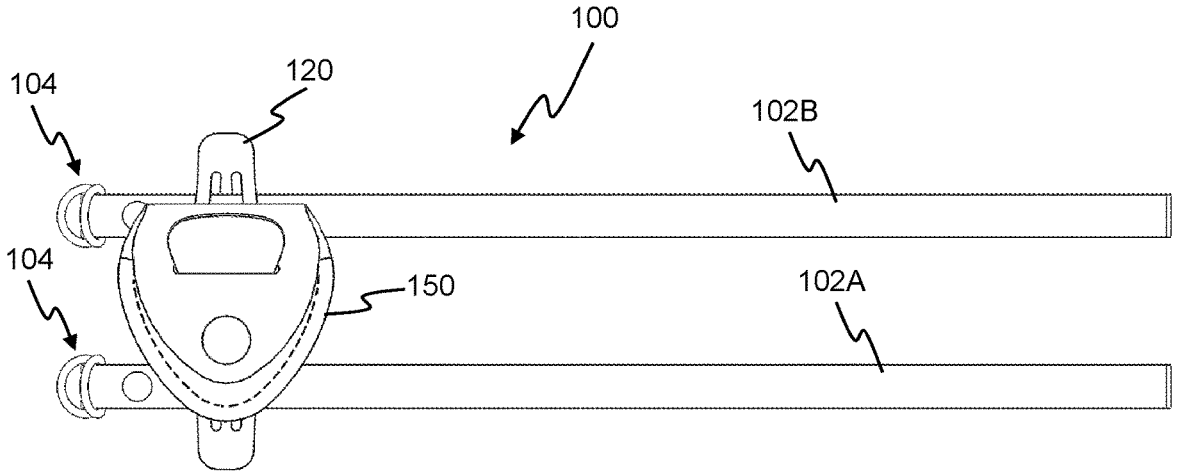
FIG. 6 shows a top view of the pick holder assembly according to FIG. 1.
Figure 7:
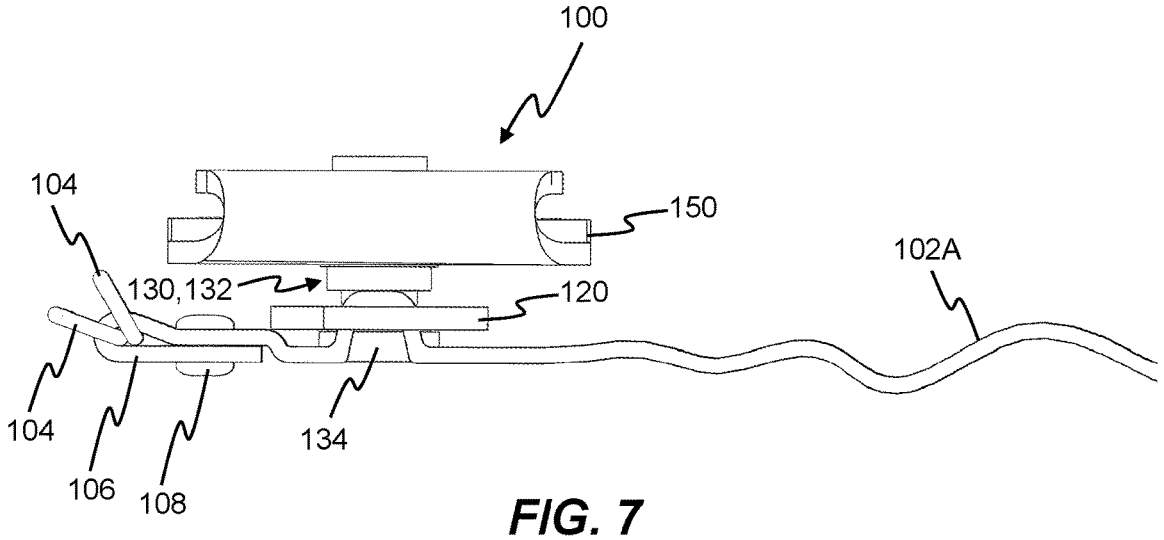
FIG. 7 shows a side view of the pick holder assembly according to FIG. 6.

In an embodiment, the string instrument 12 includes a neck 16, a head 18 connected with the neck 16, a plurality of tuning keys 20 located on the head 18, and one or more strings 14 coupled with one or more of the tuning keys 20. For example, the string instrument 12 may be, but is not limited to, a guitar, mandolin, or banjo. As illustrated in FIG. 2A, the bodies 22 of the tuning keys 20 are located on a rear surface of the string instrument head 18. In an embodiment, as shown in FIGS. 1-4, six tuning keys 20 are arranged in two rows.

In an embodiment, the string instrument pick holder assembly 100 includes two straps 102A, 102B operable to secure a saddle 120 against the string instrument head 18. The straps 102A, 102B can be made of any material including, but not limited to, leather, artificial leather, or nylon. A die and press, or a computer numerical control ("CNC") machine, may be used to cut material into the shape of the straps 102A, 102B. The straps 102A, 102B define a geometry having a length greater than their width (e.g., long and narrow). The straps 102A, 102B also include strap length adjustment hardware 104 connected to one end, or both ends, thereof. The adjustment hardware 104 allows the strap 102A, 102B to be wrapped around an object, such as the string instrument head 18, then to be tightened about and secured to the object, regardless of the size or shape of the object. In an embodiment, as illustrated in FIGS. 6-10, the adjustment hardware 104 comprises two D-Rings coupled with each of the straps 102A, 102B via a loop 106 of the strap 102A, 102B secured with a rivet 108. In other embodiments, the adjustment hardware 104 may comprise one or more slides (e.g., a tri-glide slide), hook-and-loop fasteners, or the like. In an embodiment, a portion of the straps 102A, 1026 include a layer of polymeric material to prevent the straps 102A, 1026 from slipping relative to the adjustment hardware 104. In yet another embodiment, a portion of the straps 102A, 1026 include a layer of hook-and-loop material operable to secure the ends of the straps 102A, 1026 and prevent slipping thereof relative to the adjustment hardware 104.

As illustrated in FIGS. 2A-10, in an embodiment, the saddle 120 is a generally planar component having generally parallel first and second surfaces 122, 124. A snap fastener socket 130 is connected with the first surface 122 of the saddle 120, and is generally centrally located thereon. The snap fastener socket 130 is operable to mate/connect with a snap fastener stud 132 located on a pouch 150, enabling the pouch 150 to detachably connect to the saddle 120 via the snap fastener 130, 132. In another embodiment, a hook-and-loop fastener may be connected with the saddle 120 and the pouch 150 to enable the pouch 150 to be selectively connectable with the saddle 120. In still another embodiment, a pair of magnets may be connected with the saddle 120 and the pouch 150, respectively, to enable the pouch 150 to be selectively connectable with the saddle 120.

The saddle 120 includes four slots 126A, 126B, 128A, 128B located through the first and second surfaces 122, 124. The first pair of slots 126A, 126B are located opposite the second pair of slots 128A, 1286 about the snap fastener socket 130. The slot 126B is disposed symmetrical with the slot 126A, and the slot 128B is disposed symmetrical with the slot 128A, across the longitudinal axis x of the saddle 120. In an embodiment, the first pair of slots 126A, 126B are angled relative to one another and the second pair of slots 128A, 128B are angled relative to one another such that they describe a greater distance therebetween at their proximal ends than at their distal ends. In an embodiment, the angle $\phi$ between the first pair of slots 126A, 126B and the second pair of slots 128A, 128B gradually increases from their distal ends to their proximal ends. The angle of the slots 126A, 1266, 128A, 1286 facilitates, inter alia, a more secure fit of the saddle 120 against the instrument head 18 when the straps 102A, 102B are tightened.

The saddle 120 may be made of, but is not limited to, polymeric material, plastic, metal, leather, artificial leather, or nylon. In certain embodiments, the saddle 120 comprises a rigid construction. For example, a die and press, or a CNC machine, may be used to cut material into the shape of the saddle 120. The saddle 120 may also be formed via injection molding or additive manufacturing processes. As illustrated in FIGS. 7, 9, 10, and 18, in an embodiment, a spacer 134 is coupled with the second surface 124 of the saddle 120 opposite the snap fastener socket 130. The spacer 134 facilitates vibration dampening during operation of the string instrument 12 to prevent the saddle 120 from producing unwanted noise due to repeated contact with the string instrument head 18. The spacer 134 also facilitates positioning of the pouch 150 over the tuning keys 20 and prevents marking of the instrument head 18 by the saddle 120.

Figure 8:
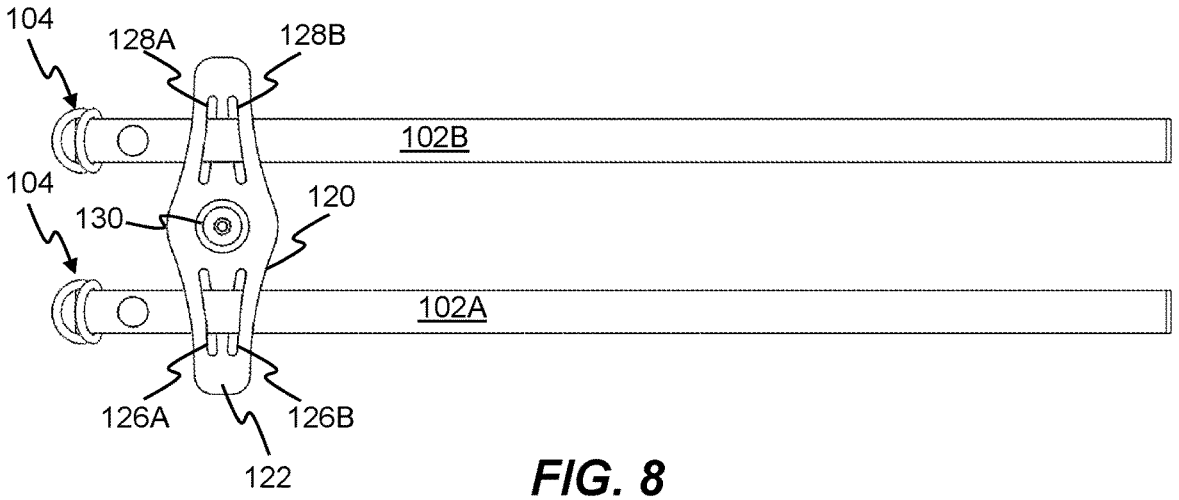
FIG. 8 shows a top view of a portion of the pick holder assembly according to FIG. 6.
Figure 9:
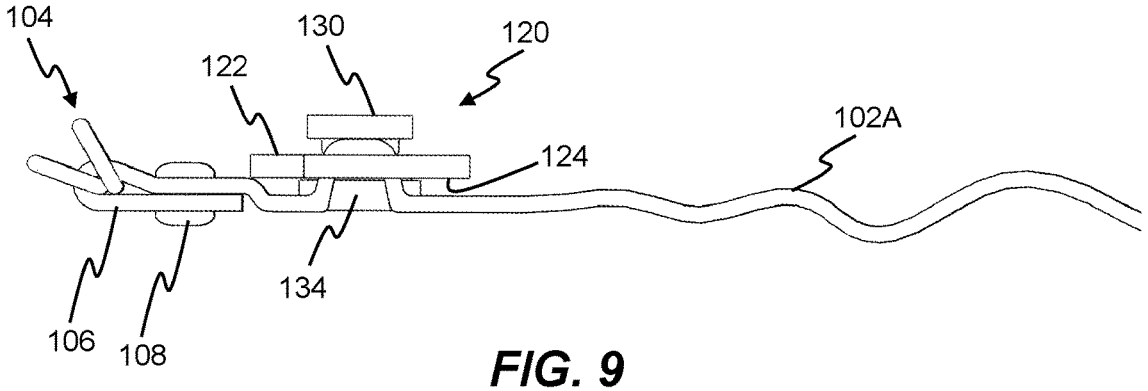
FIG. 9 shows a side view of a portion of the pick holder assembly according to FIG. 8.
Figure 10:
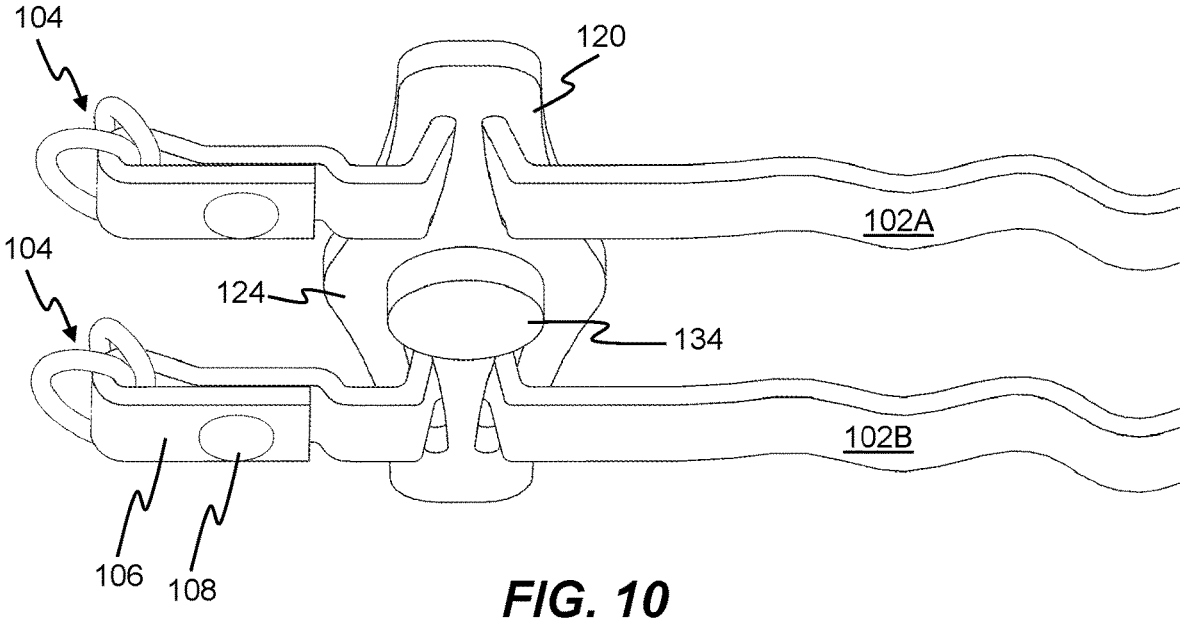
FIG. 10 shows a rear perspective view of a portion of the pick holder assembly according to FIG. 6.
Figure 11:
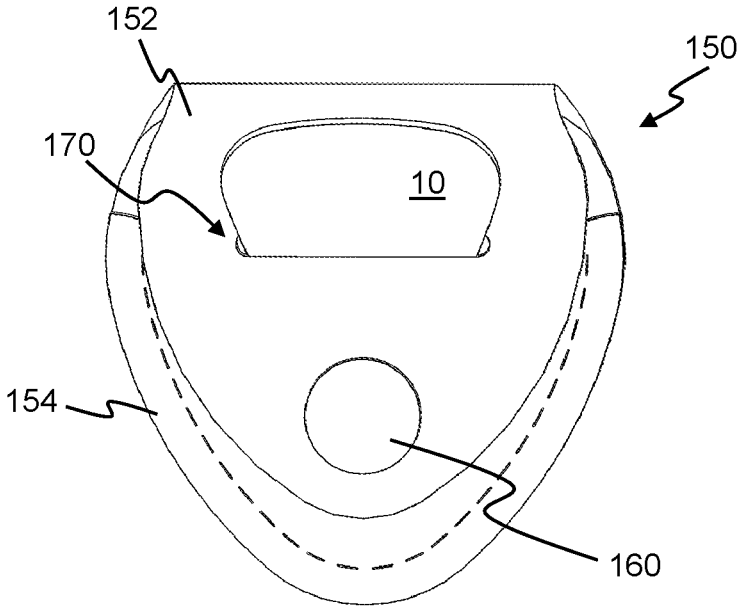
FIG. 11 shows a top view of a portion of the pick holder assembly according to FIG. 1 having a pick in the pick slot.
Figure 12:
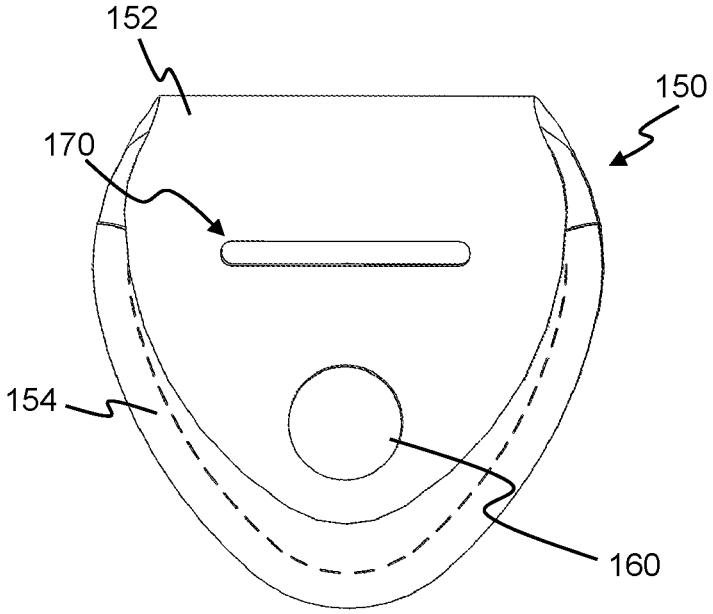
FIG. 12 shows a top view of a portion of the pick holder assembly according to FIG. 11 without a pick in the pick slot.
Figure 13:
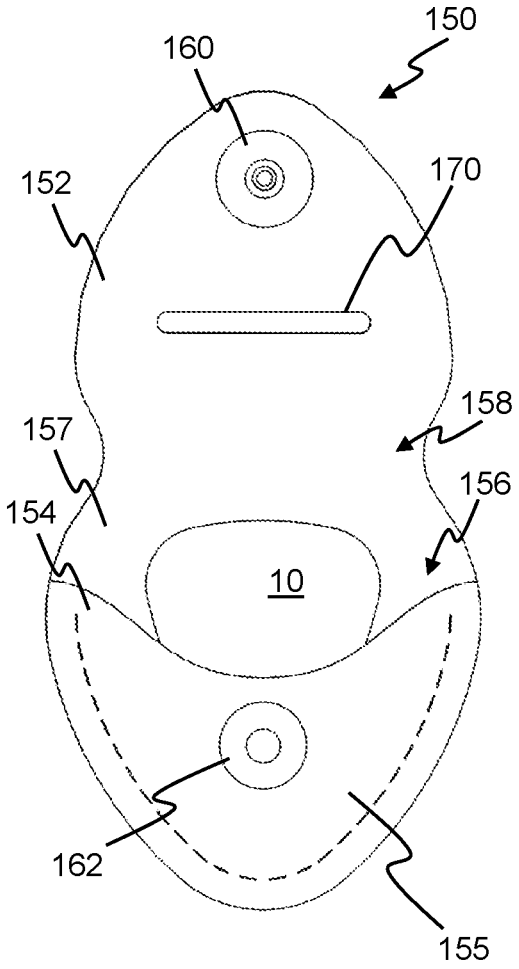
FIG. 13 shows a top view of a portion of the pick holder assembly according to FIG. 1 in an open position and having a pick.
Figure 14:
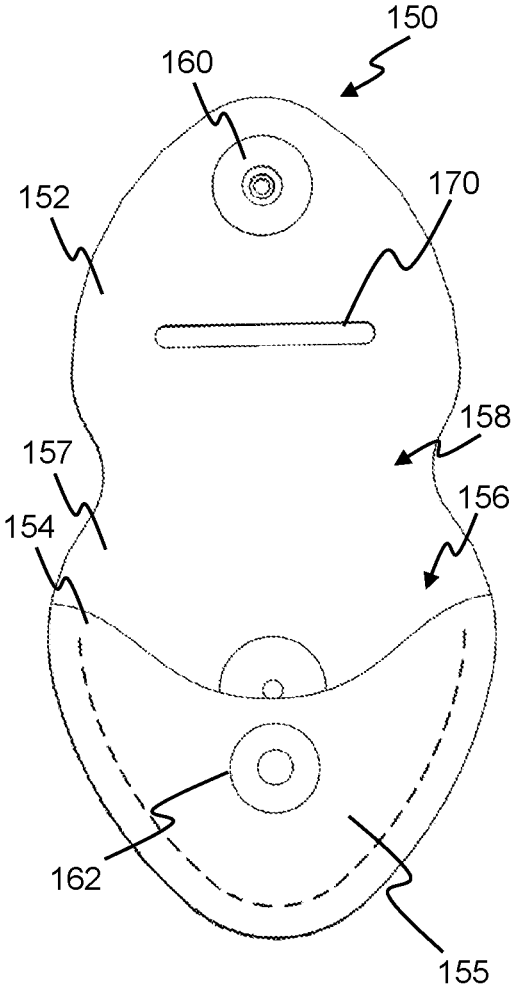
FIG. 14 shows a top view of a portion of the pick holder assembly according to FIG. 1 in an open position without a pick.
Figure 15:
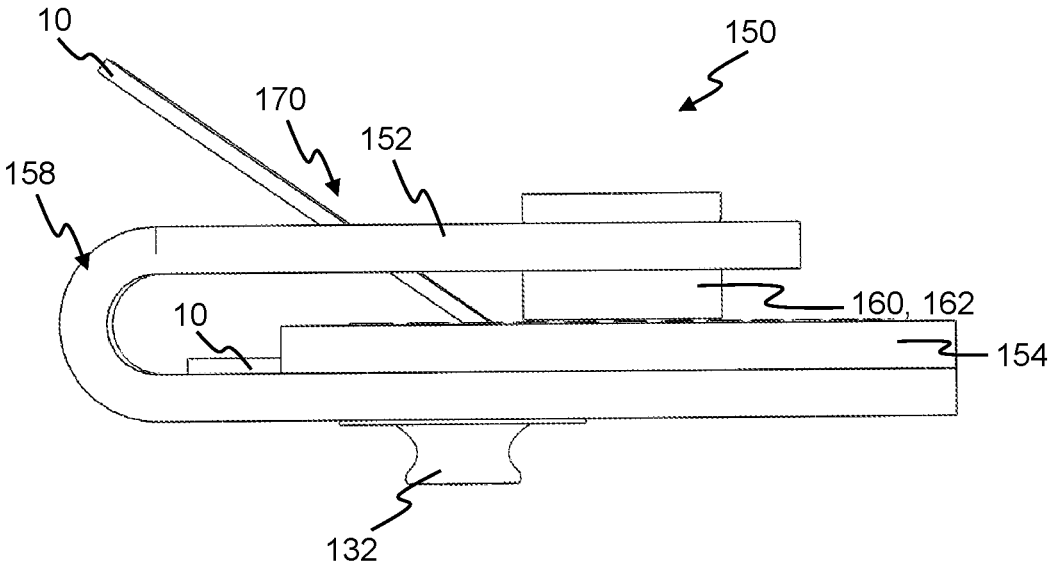
FIG. 15 shows a side view of a portion of the pick holder assembly according to FIG. 1 having a pick in the pick slot.
Figure 16:
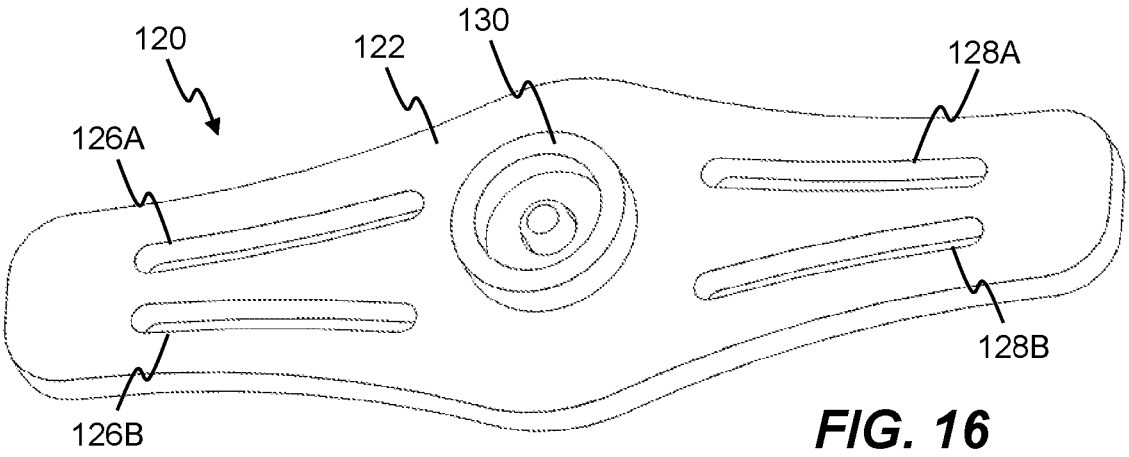
FIG. 16 shows a top perspective view of a portion of the pick holder assembly according to FIG. 1.
Figure 17:
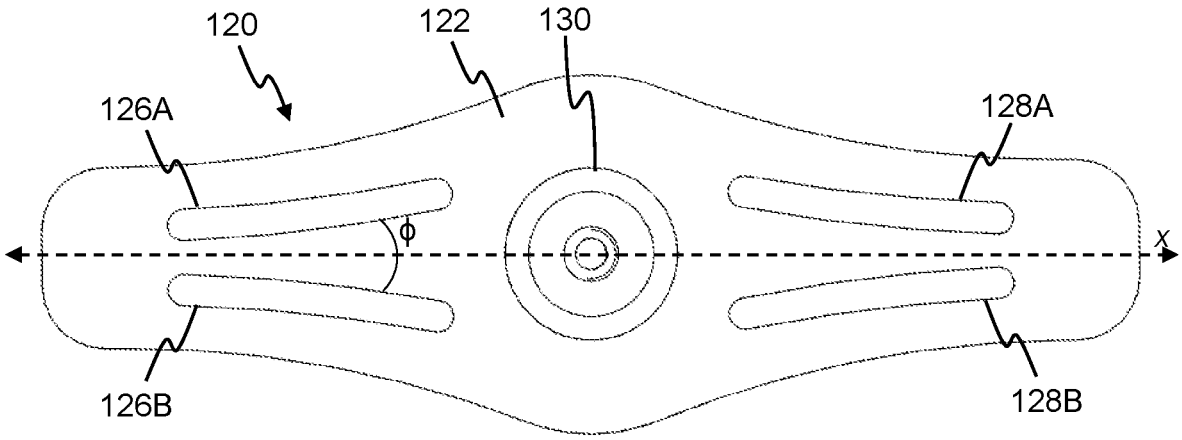
FIG. 17 shows a top view of a portion of the pick holder assembly according to FIG. 1.
Figure 18:
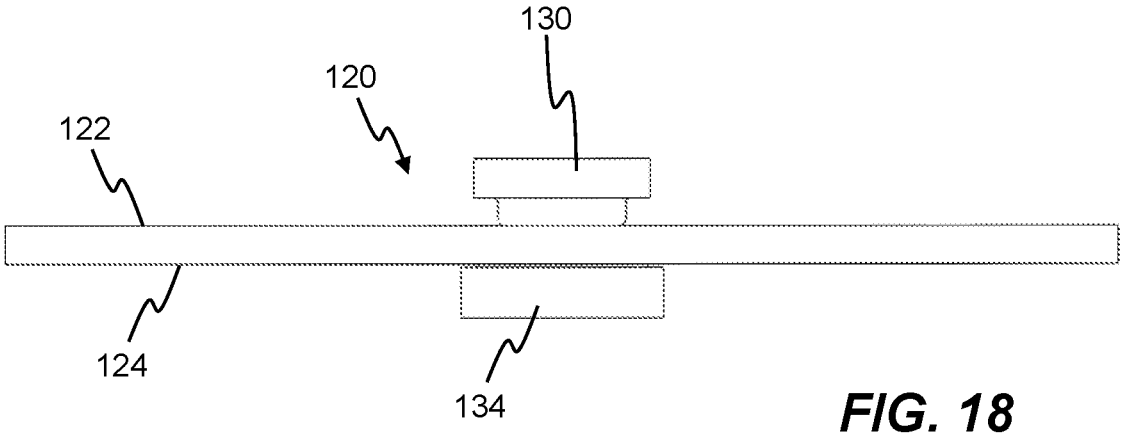
FIG. 18 shows a side view of a portion of the pick holder assembly according to FIG. 1.
Figure 19:
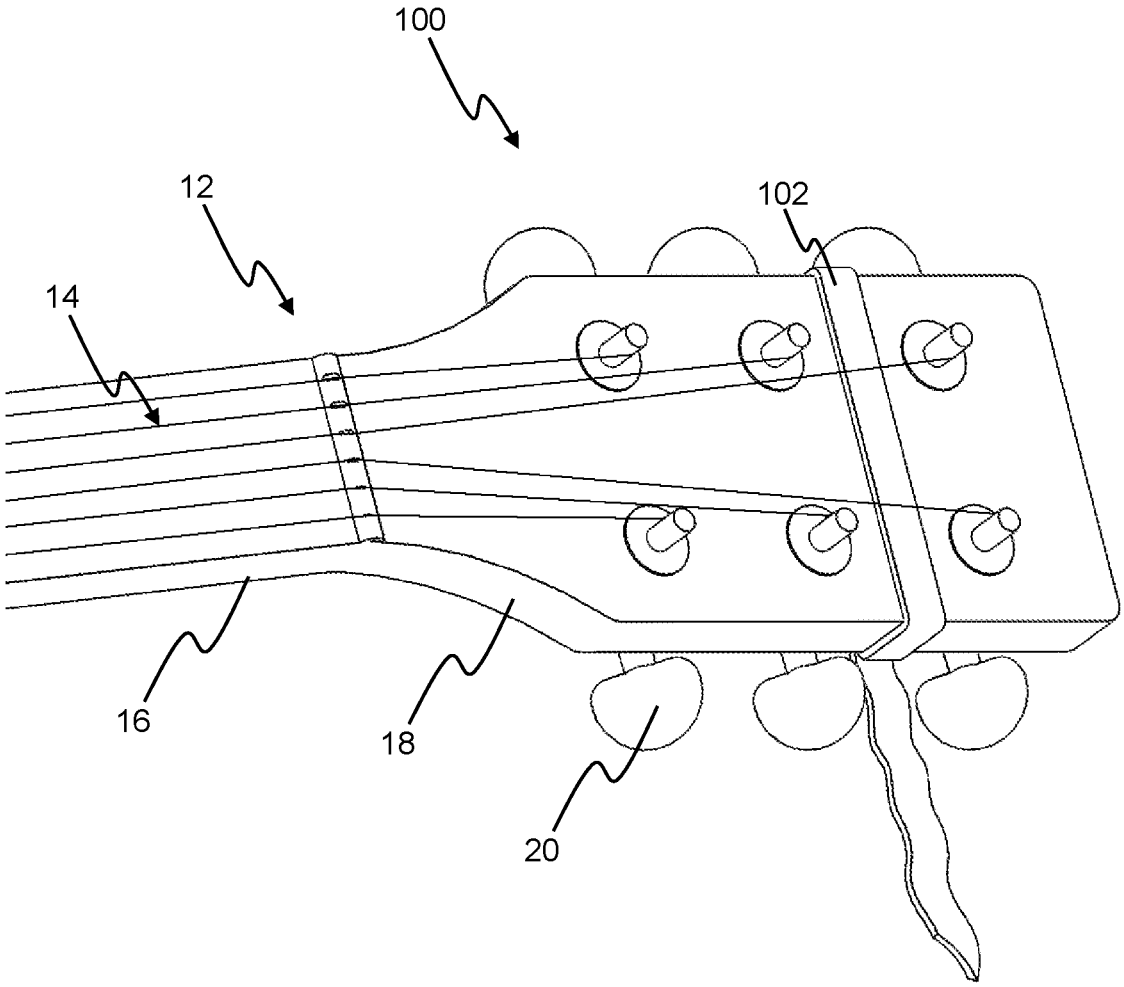
FIG. 19 shows a front perspective view of a portion of a string instrument and pick holder assembly according to an embodiment of the present disclosure.
Figure 20:
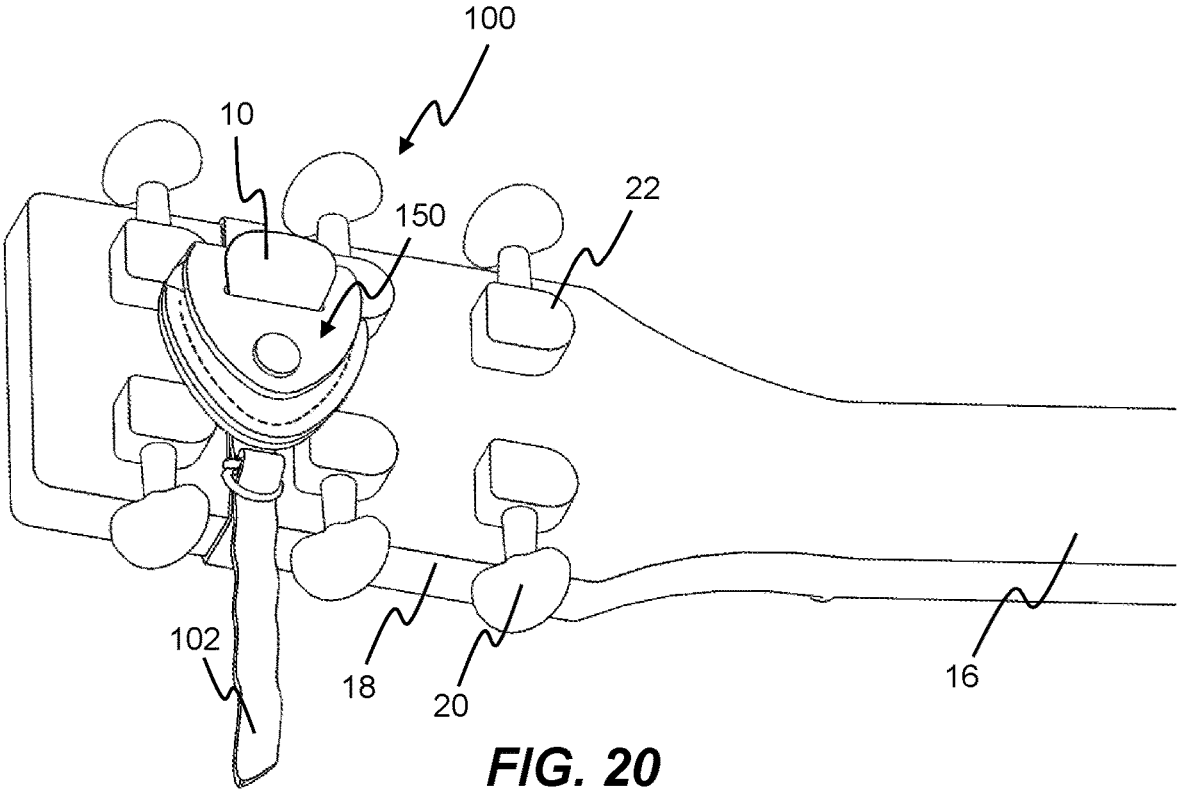
FIG. 20 shows a rear perspective view of a portion of the string instrument and pick holder assembly according to FIG. 19.
Figure 21:
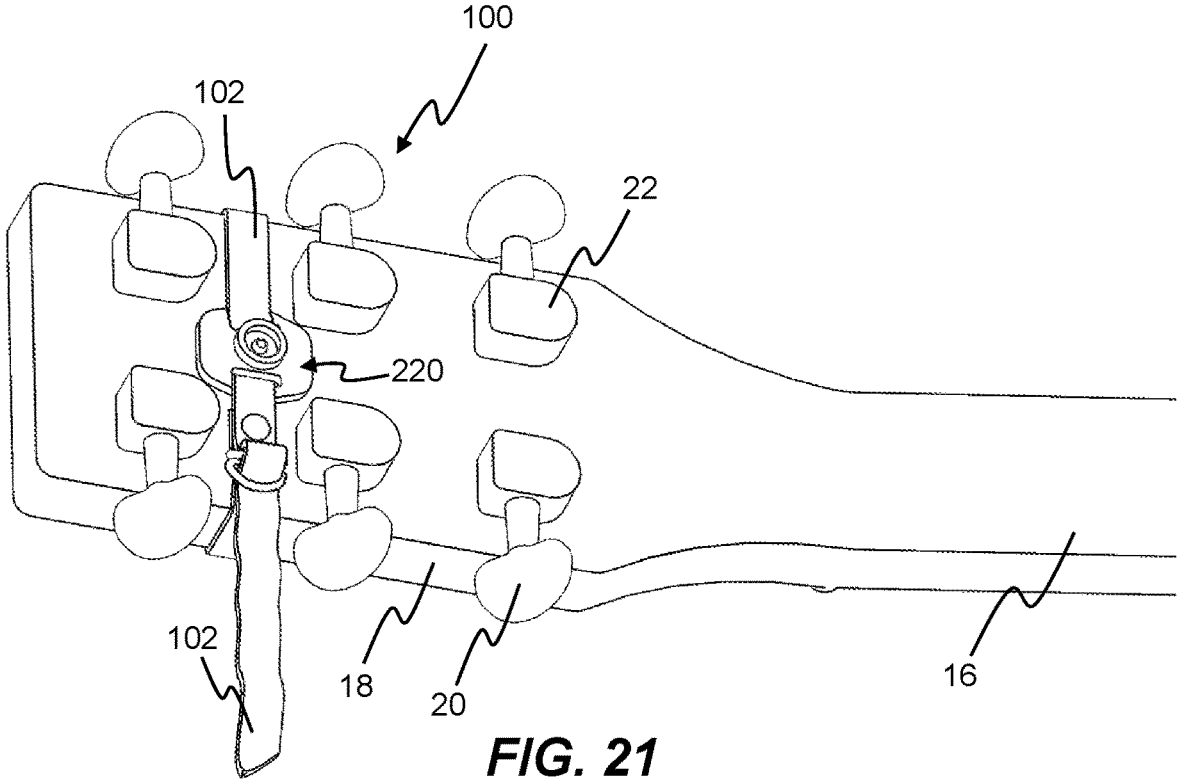
FIG. 21 shows a rear perspective view of a portion of the string instrument and a portion of the pick holder assembly according to FIG. 19.
Figure 22:
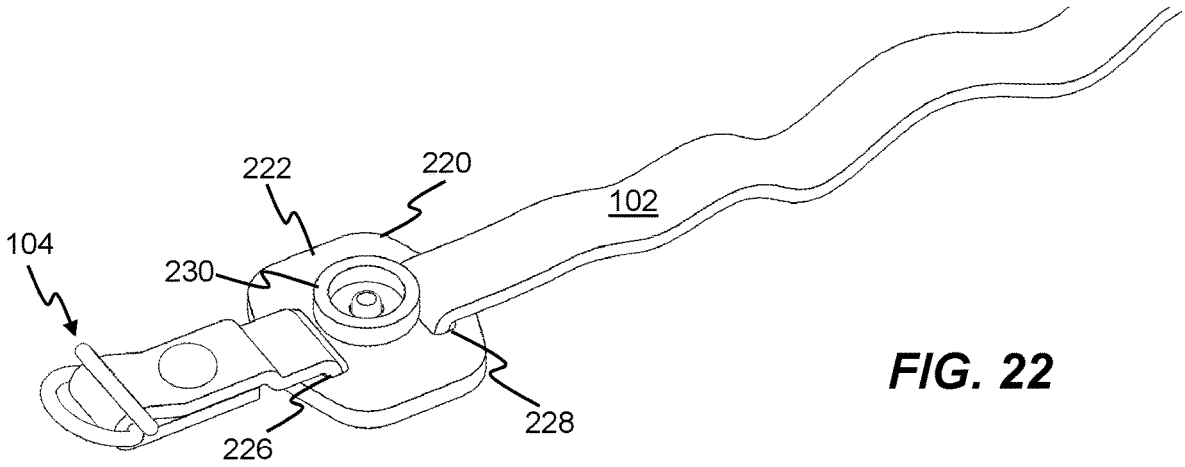
FIG. 22 shows a top perspective view of the pick holder assembly according to FIG. 19.
Figure 23:
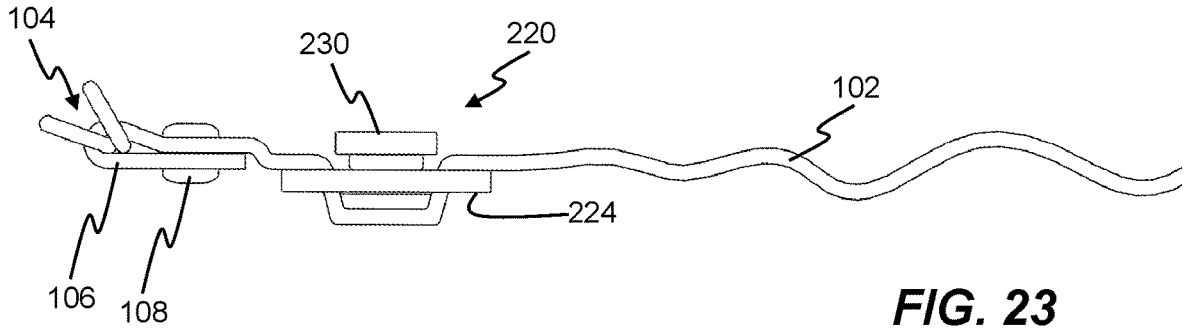
FIG. 23 shows a side view of the pick holder assembly according to FIG. 19.
Figure 24:
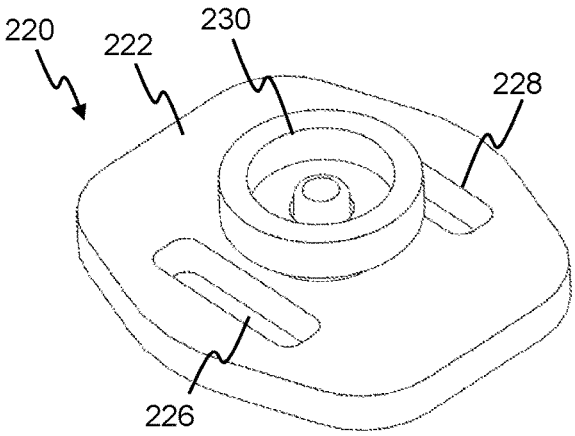
FIG. 24 shows a top perspective view of a portion of the pick holder assembly according to FIG. 19.

Referring now to FIGS. 8-10, in assembly, the first strap 102A is located through the first pair of slots 126A, 126B, and the second strap 102B is located through the second pair of slots 128A, 128B. For example, the first strap 102A is inserted through the slot 126A from the saddle second side 124 and is inserted through the slot 1266 from the saddle first side 122. The second strap 102B may be similarly disposed through the second pair of slots 128A, 1286. The arrangement of the straps 102A, 102B through the first and second pairs of slots 126A, 126B, 128A, 128B enables the saddle 120 to slide freely along the straps 102A, 102B. This configuration enables string instrument pick holder assembly 100 to be fitted to string instruments of varying size and shape.

Referring now to FIGS. 1-5, when the string instrument pick holder assembly 100 is attached to the instrument head 18, the straps 102A, 1026 are located under the strings 14 to prevent any interference therewith, and the adjustment hardware 104 is utilized to tighten the straps 102A, 102B and secure the saddle 120 against the instrument head 18. At least the spacer 134 abuts the instrument head 18 and the saddle 120 is located at least partially between the adjacent rows of tuning keys 20. Referring now to FIGS. 2A-4, when the pouch 150 is connected with the saddle 120 on the string instrument 12, the pouch 150 is located over one or more bodies 22 of the tuning keys 20.

Referring now to FIGS. 2A-4, 6-7, and 11-15, in an embodiment, the pouch 150 includes first and second pieces of material 152, 154 joined together to form a storage area 156. The pouch 150 has an outer surface 155 and an inner surface 157. For example, the two pieces of material 152, 154 may be joined via stitching and/or adhesives. The first piece of material 152 is longer than the second piece of material 154, such that the first piece of material 152 can at least partially fold over the second piece of material 154, thereby at least partially closing the storage area 156. A second snap fastener stud 160 may be located on the first piece of material 152 and a second snap fastener socket 162 may be located on the second piece of material 154. The second snap fastener 160, 162 enables the pouch storage area 156 to be securely closed. In another embodiment, a hook-and-loop fastener may be utilized to secure the pouch 150 in a closed position. In still another embodiment, a pair of magnets, one magnet located on each of the first and second pieces of material, may be utilized to secure the pouch 150 in a closed position.

The first piece of material 152 of the pouch 150 includes a slot 170 therethrough between the snap fastener stud 160 and the fold 158 in the first piece of material 152. When the pouch 150 is in a generally closed position a pick 10 may be inserted at least partially through the slot 170 to provide a user quick access to the pick 10. In an embodiment, the slot 170 is smaller in length than the greatest width of the pick 10.

As illustrated in FIGS. 19-24, in an embodiment, the string instrument pick holder assembly 200 includes a saddle 220 and a single strap 102. The saddle 220 is a generally planar component having generally parallel first and second surfaces 222, 224. A snap fastener socket 230 is connected with the first surface 222 of the saddle 220, and is generally centrally located thereon. The snap fastener socket 230 is operable to mate/connect with the snap fastener stud 132 located on the pouch 150, enabling the pouch 150 to detachably connect to the saddle 220 via the snap fastener 230, 132. As described with regard to the saddle 120, in other embodiments, a hook-and-loop fastener may be connected with the saddle 220 and the pouch 150, or a pair of magnets may be connected with the saddle 220 and the pouch 150, respectively, to enable the pouch 150 to be selectively connectable with the saddle 220.

The saddle 220 includes two slots 226, 228 located through the first and second surfaces 222, 224. The first slot 226 is located opposite the second slot 228 about the snap fastener socket 230. In an embodiment, the slot 226 is disposed generally parallel with the slot 228. The saddle 220 may be made of, but is not limited to, polymeric material, plastic, metal, leather, artificial leather, or nylon. In certain embodiments, the saddle 220 comprises a rigid construction. For example, a die and press, or a CNC machine, may be used to cut material into the shape of the saddle 220. The saddle 220 may also be formed via injection molding or additive manufacturing processes. The strap 102 is inserted through the first slot 226 from the saddle first surface 222 and is inserted through the second slot 228 from the saddle second surface 224.

One or more features of the embodiments described herein may be combined to create additional embodiments which are not depicted. While various embodiments have been described in detail above, it should be understood that they have been presented by way of example, and not limitation. It will be apparent to persons skilled in the relevant arts that the disclosed subject matter may be embodied in other specific forms, variations, and modifications without departing from the scope, spirit, or essential characteristics thereof. The embodiments described above are therefore to be considered in all respects as illustrative, and not restrictive. The scope of the invention is indicated by the appended claims, and all changes that come within the meaning and range of equivalents thereof are intended to be embraced therein.

What is claimed is:

1. A string instrument pick holder assembly, comprising:
a pouch operable to store one or more instrument picks;
said pouch having an inner surface configured to contain said one or more picks, and an outer surface located opposite said inner surface;
a first portion of a fastener connected with said outer surface of said pouch;
a saddle having a first surface and a second surface, wherein said second surface is located opposite said first surface;
a second portion of said fastener coupled with said first surface;
said second portion of said fastener is operable to detachably connect with said first portion of said fastener;
a strap coupled with said saddle, wherein said strap is operable to connect said saddle with a string instrument; and
wherein said pouch is detachable from said saddle.

2. The string instrument pick holder assembly according to claim 1, further comprising a first slot located through said first surface and said second surface of said saddle, and a second slot located through said first surface and said second surface of said saddle, wherein said strap is located through said first slot and said second slot.

3. The string instrument pick holder assembly according to claim 2, wherein said strap is detachable from said saddle.

4. The string instrument pick holder assembly according to claim 2, wherein said saddle comprises a third slot located through said first surface and said second surface, and a fourth slot located through said first surface and said second surface, wherein said third slot and said fourth slot are located symmetric with said first slot and said second slot about said second portion of said fastener.

5. The string instrument pick holder assembly according to claim 4, further comprising a second strap located through said third slot and said fourth slot, wherein said second strap is operable to connect said saddle with said string instrument.

6. The string instrument pick holder assembly according to claim 4, wherein said second slot is angled relative to said first slot, and said fourth slot is angled relative to said third slot.

7. The string instrument pick holder assembly according to claim 1, further comprising a spacer coupled with said second surface of said saddle.

8. The string instrument pick holder assembly according to claim 1, further comprising adjustment hardware coupled with an end of said strap, whereby a length of said strap is operable to be adjusted.

9. The string instrument pick holder assembly according to claim 1, wherein said pouch comprises a first piece of material, and a second piece of material coupled with said first piece of material, wherein said first piece of material and said second piece of material define a pick storage area.

10. The string instrument pick holder assembly according to claim 9, wherein said first piece of material is operable to fold at least partially over said second piece of material, whereby said pick storage area is in a closed position.

11. The string instrument pick holder assembly according to claim 9, wherein said pouch comprises a slot located through said first piece of material, and wherein said slot is operable to hold a pick located at least partially therethrough.

12. The string instrument pick holder assembly according to claim 1, wherein said aid string instrument includes a head having a first surface, and a second surface located opposite said first surface, two or more tuning keys coupled with said instrument head, wherein said two or more tuning keys each comprise a body located on said second surface of said head; and wherein said saddle is operable to be positioned adjacent to said two or more tuning keys.

13. The string instrument pick holder assembly according to claim 12, wherein said strap is operable to be located about said string instrument head, and wherein said strap is located under one or more strings coupled with said first surface of said head.

14. The string instrument pick holder assembly according to claim 12, wherein said two or more tuning keys comprise at least two columns and two rows; and wherein said strap is located between two rows of said two or more tuning keys.

15. The string instrument pick holder assembly according to claim 12, wherein said pouch is located adjacent to a surface of said two or more tuning keys.

16. The string instrument pick holder assembly according to claim 15, wherein said pouch abuts said surface of said two or more tuning keys.

17. The string instrument pick holder assembly according to claim 8, wherein said strap comprises a first end and a second end, said adjustment hardware is coupled with said first end, and said second end is detachable from said adjustment hardware.

18. A string instrument accessory assembly, comprising:

a saddle having a first surface and a second surface, wherein said second surface is located opposite said first surface;

a first portion of a fastener coupled with said first surface of said saddle;

an accessory having a second portion of said fastener operable to detachably connect with said first portion of said fastener;

a strap coupled with said saddle, wherein said strap is operable to connect said saddle with a string instrument; and wherein said accessory is detachable from said saddle.

19. A string instrument pick holder assembly, comprising:

a pouch operable to store one or more instrument picks;

said pouch having an inner surface configured to contain said one or more picks, and an outer surface located opposite said inner surface;

a strap coupled with said pouch, wherein said strap is operable to connect said pouch with a string instrument;

wherein said string instrument comprises a head, and two or more tuning keys coupled with said instrument head, and wherein said pouch is operable to be positioned adjacent to said two or more tuning keys.

20. The string instrument pick holder assembly according to claim 19, wherein said strap is operable to be positioned between said two or more tuning keys.

* * * * *